US010642192B2

(12) United States Patent
Ariizumi et al.

(10) Patent No.: US 10,642,192 B2
(45) Date of Patent: May 5, 2020

(54) DEVELOPING DEVICE HAVING A FEEDING SCREW WITH MULTIPLE BLADE PORTIONS

(71) Applicant: CANON KABUSHIKI KAISHA, Tokyo (JP)

(72) Inventors: Osamu Ariizumi, Matsudo (JP); Shunsuke Tsuda, Tokyo (JP); Mitsuyoshi Arakawa, Tokyo (JP); Masahiro Ootsuka, Tokyo (JP); Fumiyoshi Saito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/982,023

(22) Filed: May 17, 2018

(65) Prior Publication Data

US 2018/0335722 A1 Nov. 22, 2018

(30) Foreign Application Priority Data

May 22, 2017 (JP) ..... 2017-100859

(51) Int. Cl.
*G03G 15/08* (2006.01)

(52) U.S. Cl.
CPC ..... *G03G 15/0891* (2013.01); *G03G 15/0808* (2013.01); *G03G 15/0812* (2013.01);
(Continued)

(58) Field of Classification Search
CPC ..... G03G 15/0891; G03G 15/0808; G03G 15/0812; G03G 2215/083; G03G 15/0865;
(Continued)

(56) References Cited

U.S. PATENT DOCUMENTS 5,963,766 A 10/1999 Okuno et al.
7,881,638 B2 2/2011 Noguchi et al.
(Continued)

FOREIGN PATENT DOCUMENTS

JP H03-282489 A 12/1991
JP H11-84874 A 3/1999
(Continued)

OTHER PUBLICATIONS

Shunsuke Tsuda et al., U.S. Appl. No. 15/982,028, filed May 17, 2018.
(Continued)

*Primary Examiner* — David M. Gray
*Assistant Examiner* — Laura Roth
(74) *Attorney, Agent, or Firm* — Venable LLP

(57) ABSTRACT

A developing device includes a developer carrying member, a first chamber, a second chamber, a first communicating portion, a second communicating portion, and a feeding screw, provided in the second chamber, including a feeding portion having a first helical blade and including a returning portion having a second helical blade in the form of a plurality of threads, the feeding portion and the returning portion being provided so that a boundary portion therebetween opposes the second communicating portion. The first helical blade and the second helical blade satisfy the following relationship: P2≥P1, where P1 is a pitch, or lead, of the first helical blade and P2 is a lead of the second helical blade.

14 Claims, 10 Drawing Sheets

(52) U.S. Cl.
CPC ..... *G03G 15/0893* (2013.01); *G03G 15/0865* (2013.01); *G03G 15/0877* (2013.01); *G03G 2215/083* (2013.01); *G03G 2215/0833* (2013.01)

(58) Field of Classification Search
CPC ..... G03G 15/163; G03G 15/0877; G03G 2221/1657; G03G 21/1647
See application file for complete search history.

(56) References Cited

U.S. PATENT DOCUMENTS

| | | | |
|---|---|---|---|
| 8,369,752 | B2 | 2/2013 | Furuta et al. |
| 8,515,317 | B2 | 8/2013 | Yoshimoto et al. |
| 8,611,797 | B2 | 12/2013 | Maeda et al. |
| 9,291,945 | B2 | 3/2016 | Saito |
| 9,405,229 | B1 | 8/2016 | Nose et al. |
| 9,459,558 | B1 | 10/2016 | Onuki et al. |
| 9,658,573 | B2 | 5/2017 | Saito |
| 2010/0124442 | A1 | 5/2010 | Hatakeyama et al. |
| 2013/0149009 | A1* | 6/2013 | Iwata ..... G03G 15/0893 399/254 |
| 2015/0248078 | A1 | 9/2015 | Mugita et al. |
| 2016/0004182 | A1 | 1/2016 | Yago et al. |
| 2016/0370733 | A1* | 12/2016 | Suenami ..... G03G 15/0889 |
| 2017/0269505 | A1 | 9/2017 | Ariizumi et al. |
| 2017/0308005 | A1 | 10/2017 | Ariizumi |
| 2018/0017895 | A1 | 1/2018 | Ariizumi |

FOREIGN PATENT DOCUMENTS

| | | | |
|---|---|---|---|
| JP | 2002-006631 | A | 1/2002 |
| JP | 2007-271830 | A | 10/2007 |
| JP | 2007-334101 | A | 12/2007 |
| JP | 2010-072279 | A | 4/2010 |
| JP | 2011-203330 | A | 10/2011 |
| JP | 2013-120288 | A | 6/2013 |
| JP | 2013-186138 | A | 9/2013 |
| JP | 2014-089307 | A | 5/2014 |
| JP | 2015-152714 | A | 8/2015 |

OTHER PUBLICATIONS

Fumiyoshi Saito, U.S. Appl. No. 15/969,937, filed May 3, 2018.
European Search Report dated Nov. 7, 2018, in related European Patent Application No. 18171997.2.

* cited by examiner (a)

(b)

DEVELOPING DEVICE HAVING A FEEDING SCREW WITH MULTIPLE BLADE PORTIONS

FIELD OF THE INVENTION AND RELATED ART

The present invention relates to a developing device including a feeding screw for circulating and feeding a developer in a developing container and relates to an image forming apparatus, including the developing device, such as a printer, a copying machine, a facsimile machine or a multi-function machine.

The image forming apparatus, such as the printer, the copying machine, the facsimile machine or the multi-function machine, using electrophotography includes the developing device for developing visualizing, with the developer, an electrostatic latent image formed on a photosensitive drum. In the developing device, a two-component developer consisting of toner and a carrier is used. In the developing device, a developing chamber and a stirring chamber are caused to communicate with each other through communication ports, and circulation and feeding of the developer through the communication ports are realized by feeding screws provided in the respective chambers (Japanese Laid-Open Patent Application (JP-A) 2013-120288). Further, a developing device of a so-called ACR (auto carrier refresh) type in which not only a fresh (new) developer is supplied to a developing container but also an excessive developer is discharged through a discharge opening has been known.

Thus, in the developing device disclosed in JP-A 2013-120288, a constitution in which a returning screw with a plurality of threads is provided is employed. However, a pitch of the returning screw with the plurality of threads is smaller than a height of a feeding screw, and therefore, a developer feeding amount per (one) rotation is larger by the feeding screw than by the returning screw. As a result, the developer is moved toward the returning screw side and thus there is a liability that the developer does not readily move toward the communication ports.

SUMMARY OF THE INVENTION

A principal object of the present invention is to provide a developing device capable of satisfactorily maintaining a downstream delivering property of a developer through communication ports in a developing container.

According to an aspect of the present invention, there is provided a developing device comprising: a developer carrying member configured to carry a developer; a first chamber configured to accommodate the developer for supplying the developer to the developer carrying member; a second chamber configured to form a circulating path of the developer; a first communicating portion configured to deliver the developer from the first chamber to the second chamber; a second communicating portion configured to deliver the developer from the second chamber to the first chamber; and a feeding screw, provided in the second chamber, including a feeding portion having a first helical blade configured to feed the developer in a first direction from the first communicating portion toward the second communicating portion and including a returning portion having a second helical blade in the form of a plurality of threads configured to feed the developer fed to the feeding portion in a second direction opposite to the first direction, the feeding portion and the returning portion being provided as parts of the feeding screw so that a boundary portion between the feeding portion and the returning portion opposes the second communicating portion, wherein the first helical blade and the second helical blade satisfy the following relationship: $P2 \geq P1$, where P1 is a pitch of the first helical blade and P2 is a pitch of the second helical blade.

Further features of the present invention will become apparent from the following description of exemplary embodiments with reference to the attached drawings.

Figure 8:
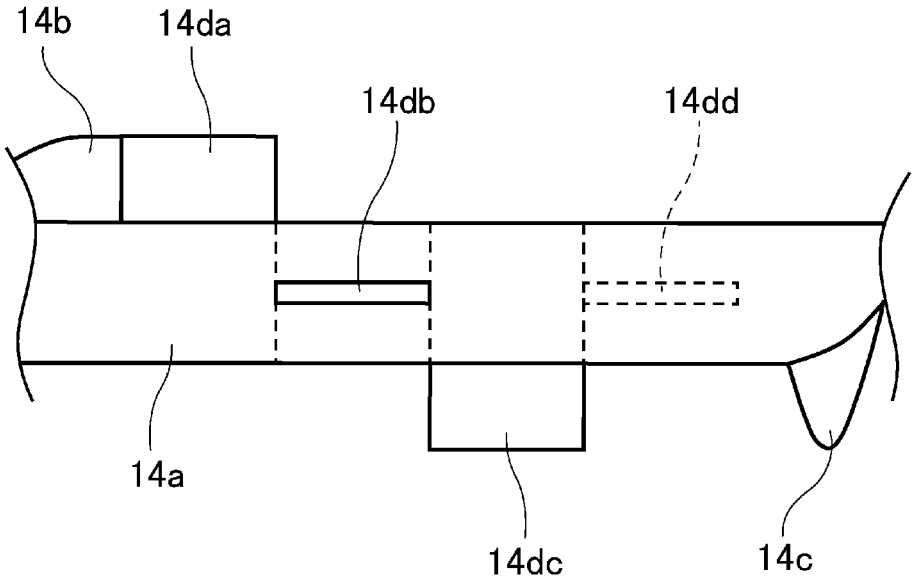
Figure 8:
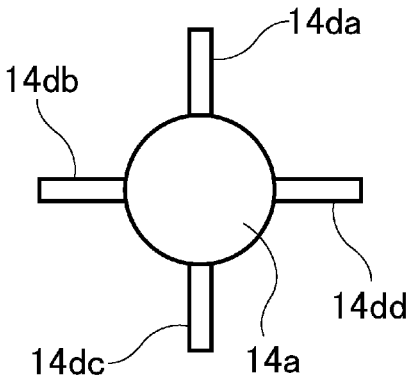

Parts (a) and (b) of FIG. 8 are schematic views for illustrating a paddle, wherein part (a) of FIG. 8 is the schematic view as seen from a side surface, and part (b) of FIG. 8 is the schematic view as seen in a rotational axis direction.

Figure 9:
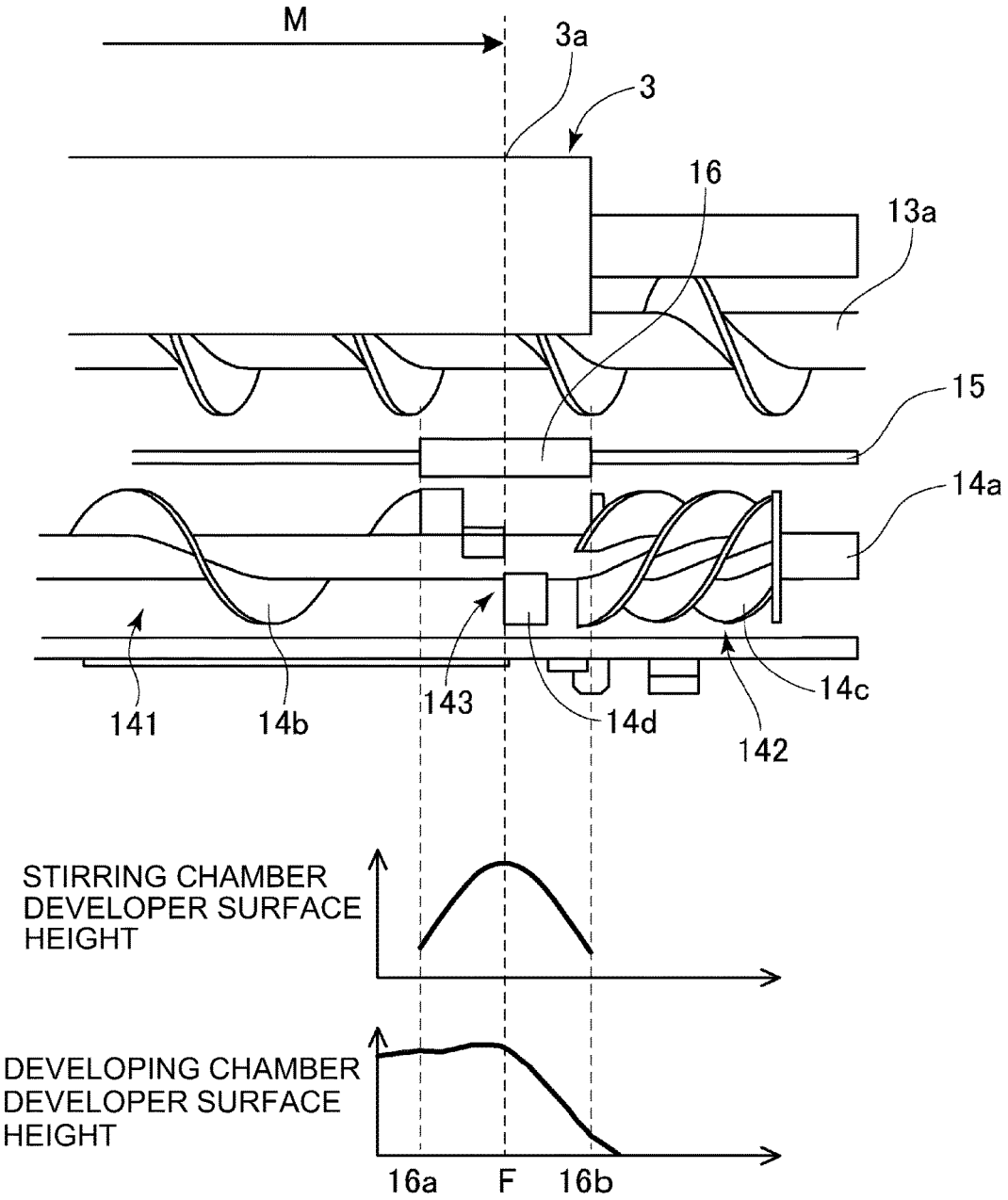

FIG. 9 is a schematic view for illustrating a positional relationship between a connecting portion and a coated region.

Figure 10:
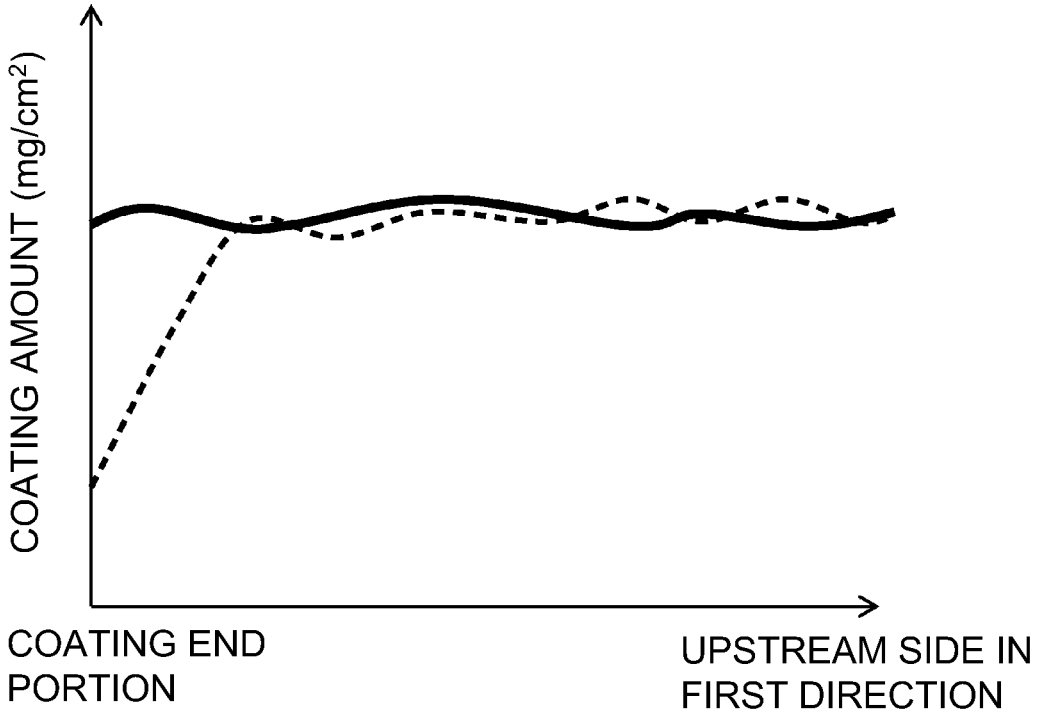

FIG. 10 is a graph showing an experimental result.

Figure 11:
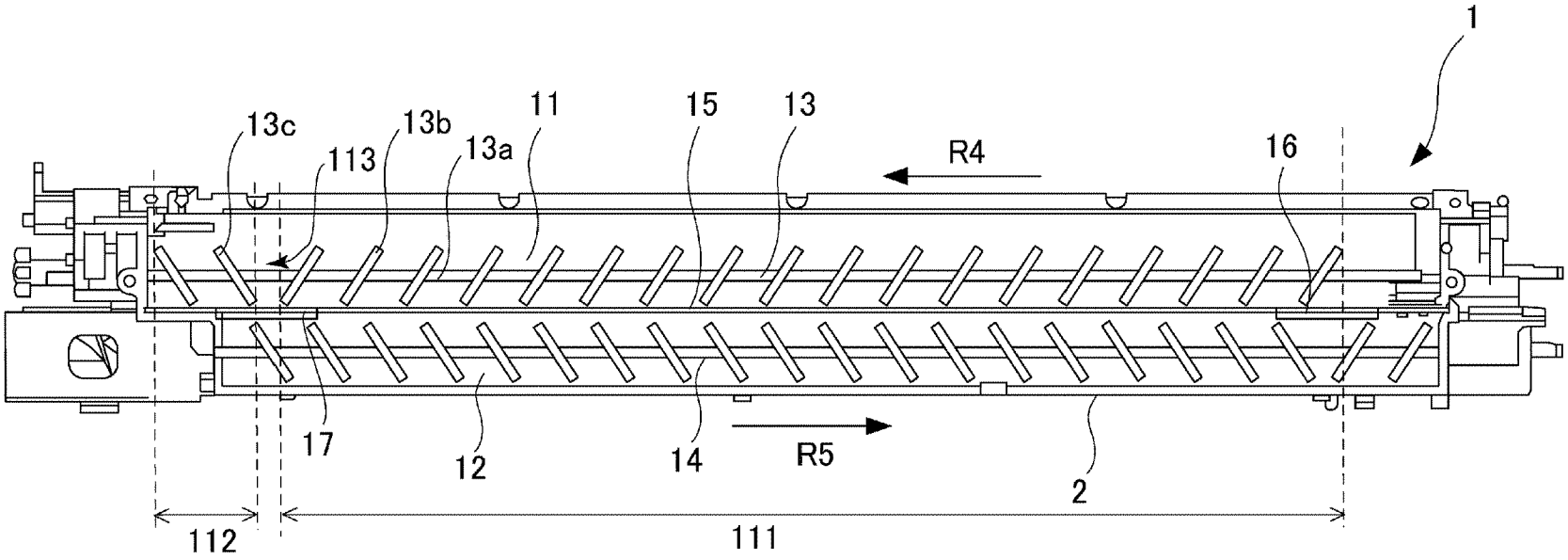

FIG. 11 is a top plan view of a developing device of a Third Embodiment.

DESCRIPTION OF EMBODIMENTS

First Embodiment

Figure 1:
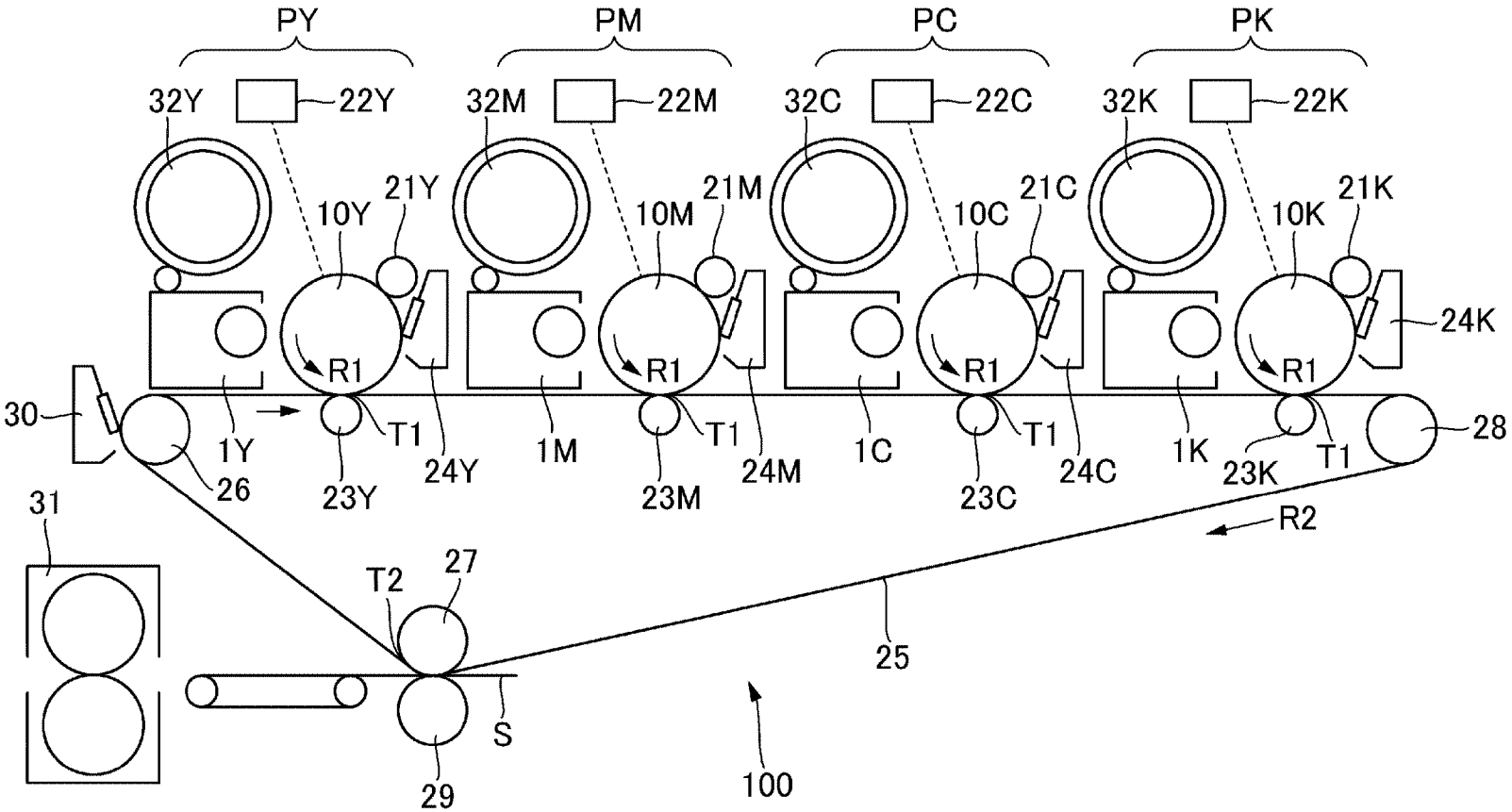
FIG. 1 is a schematic view showing a structure of an image forming apparatus to which a developing device of a First Embodiment is applied.

First, a structure of an image forming apparatus to which a developing device according to the First Embodiment is applied will be described with reference to FIG. 1. An image forming apparatus 100 shown in FIG. 1 is an intermediary transfer type full-color printer of a tandem type in which image forming portions PY, PM, PC and PK are arranged along an intermediary transfer belt 25.

<Image Forming Apparatus>

At the image forming portion PY, a yellow toner image is formed on a photosensitive drum 10Y and then is transferred onto the intermediary transfer belt 25. At the image forming portion PM, a magenta toner image is formed on a photosensitive drum 10M and then is transferred onto the intermediary transfer belt 25. At the image forming portion PC and PK, cyan and black toner images are formed on photosensitive drums 10C and 10K respectively, and then are transferred onto the intermediary transfer belt 25. The four color toner images transferred on the intermediary transfer belt 25 are fed to a secondary transfer portion (secondary transfer nip) T2 and are secondary-transferred together onto a recording material S (sheet material such as a sheet or an OHP sheet). The recording material S is taken out one by one from an unshown feeding cassette and then is fed to the secondary transfer portion T2.

The image forming portions PY, PM, PC and PK have the substantially same constitution except that colors of toners used in developing devices 1Y, 1M, 1C and 1K, respectively, are yellow, magenta, cyan and black, respectively. In the following, constituent elements of the image forming portions are represented by reference numerals or symbols from which suffixes Y, M, C and K for representing a difference in color for the image forming portions PY, PM, PC and PK are omitted, and constitutions and operations of the image forming portions PY to PK will be described.

The image forming portion P includes, at a periphery of the photosensitive drum 10 as an image bearing member, a charging roller 21, an exposure device 22, the developing device 1, a transfer roller 23 and a drum cleaning device 24. The photosensitive drum 10 is prepared by forming a photosensitive layer on an outer peripheral surface of an aluminum cylinder, and is rotated in an arrow R1 direction in FIG. 1 at a predetermined process speed.

Figure 2:
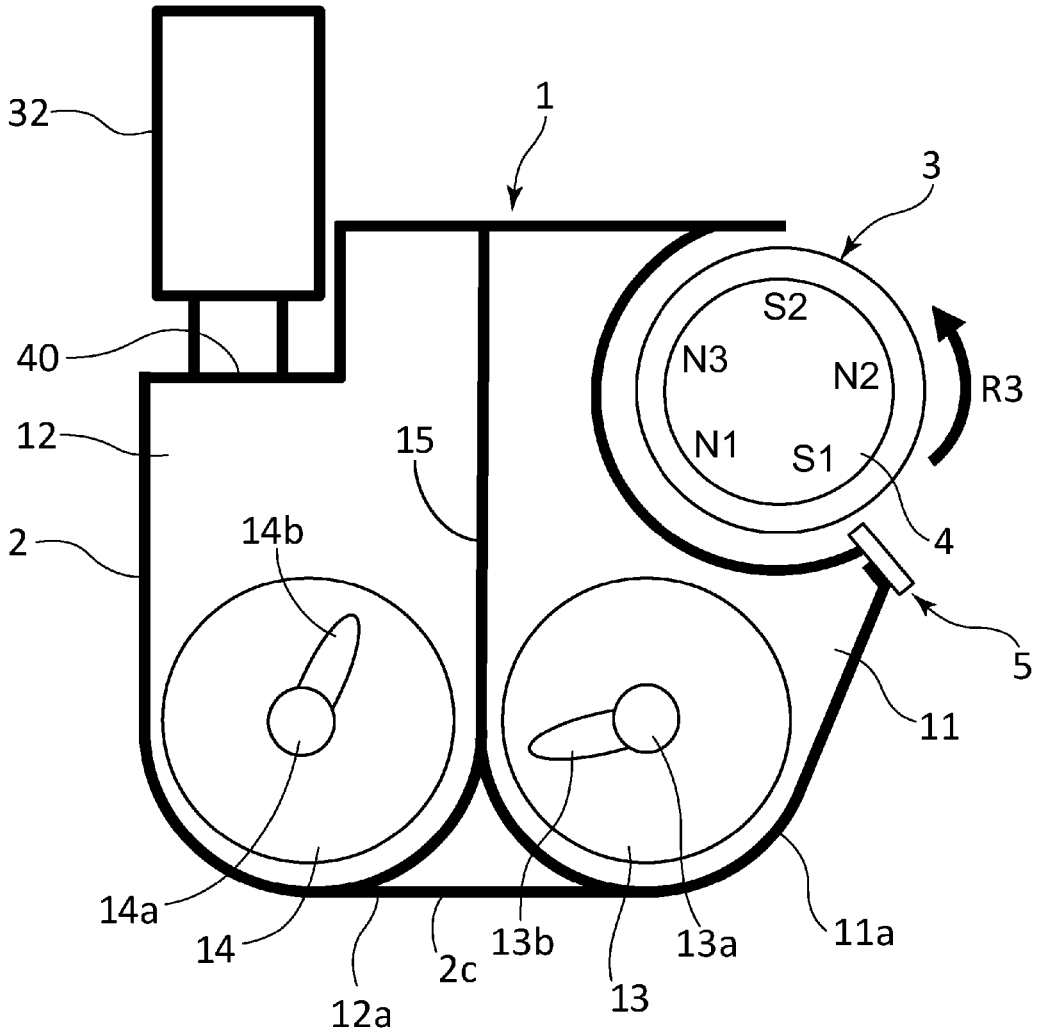
FIG. 2 is a sectional view showing the developing device of the First Embodiment.
Figure 3:
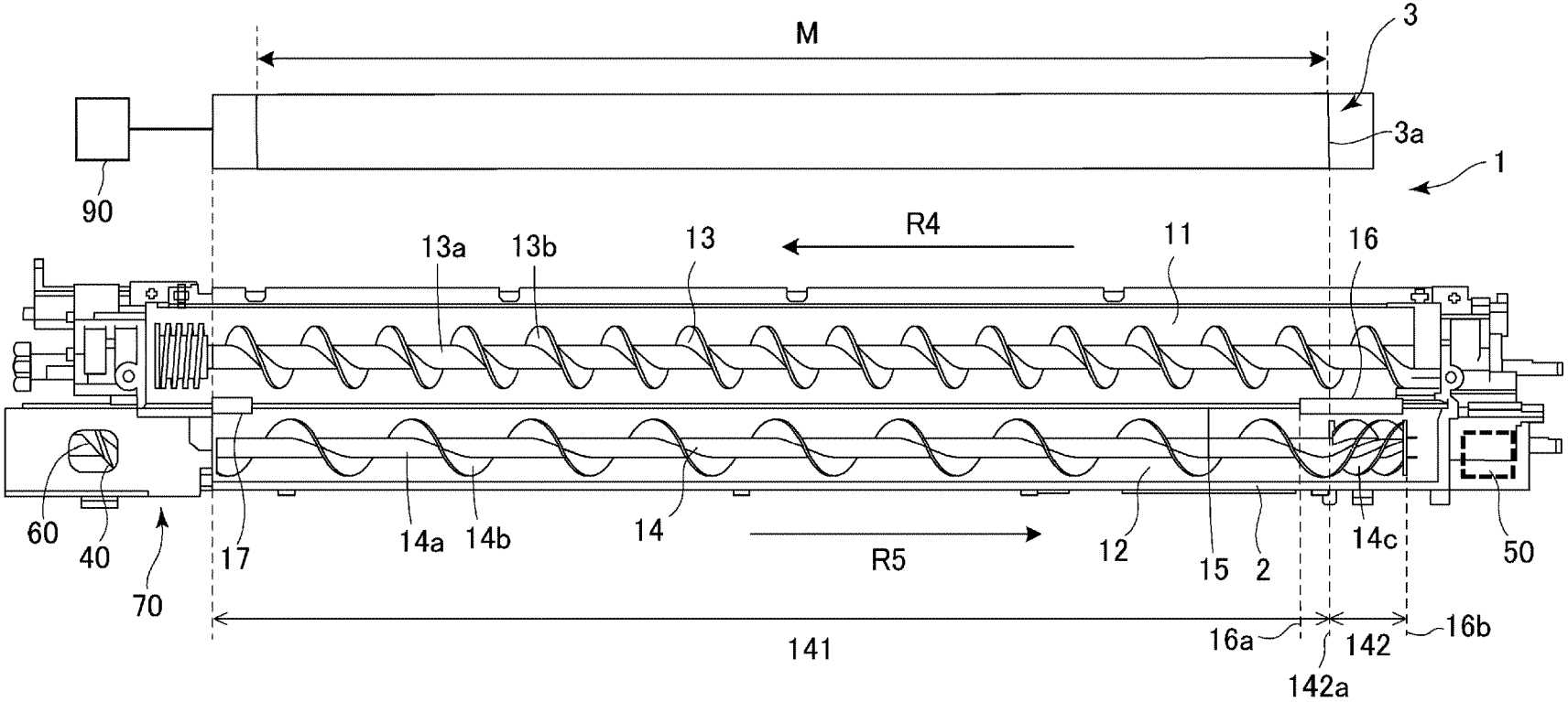
FIG. 3 is a top plan view of the developing device of the First Embodiment.

The charging roller 21 electrically charges the photosensitive drum 10 to a uniform negative dark-portion potential in contact with the photosensitive drum 10 under application of a charging voltage. The exposure device 22 generates a laser beam, from a laser beam emitting element, obtained by subjecting scanning line image data which is developed from an associated color component image to ON-OFF modulation and then to scanning through a rotating mirror, so that an electrostatic image for an image is formed on the surface of the charged photosensitive drum 10. The developing device 1 supplies the toner to the photosensitive drum 10 and develops the electrostatic image into the toner image. The developing device 1 will be specifically described later (FIGS. 2 and 3).

The transfer roller 23 is disposed opposed to the photosensitive drum 10 via the intermediary transfer belt 25 and forms a toner image primary transfer portion (primary transfer nip) T1 between the photosensitive drum 10 and the intermediary transfer belt 25. By applying a primary transfer voltage from, for example, a high-voltage source (not shown) to the primary transfer roller 23 at the primary transfer portion T1, the toner image is primary-transferred from the photosensitive drum 10 onto the intermediary transfer belt 25. That is, when the primary transfer voltage of an opposite polarity to a change polarity of the toner is applied to the transfer roller 23, the toner image on the photosensitive drum 10 is electrically attracted to the intermediary transfer belt 25, so that transfer of the toner image is carried out. The drum cleaning device 24 rubs the photosensitive drum 10 with a cleaning blade, and removes primary transfer residual toner slightly remaining on the photosensitive drum 10 after the primary transfer.

The intermediary transfer belt 25 is extended around and supported by a tension roller 26, an inner secondary transfer roller 27, a driving roller 28 and the like, and is driven by the driving roller 28, so that the intermediary transfer belt 25 is rotated in an arrow R2 direction in FIG. 1. The secondary transfer portion T2 is a toner image transfer nip where the toner image is transferred onto a recording material S formed by contact of the inner secondary transfer roller 27 with the intermediary transfer belt 25 supported by an outer secondary transfer roller 29. At the secondary transfer portion T2, by applying a predetermined secondary transfer voltage to the inner secondary transfer roller 27, the toner image is secondary-transferred from the intermediary transfer belt 25 onto the recording material S nipped and fed to the secondary transfer portion T2. Secondary transfer residual toner remaining on the intermediary transfer belt 25 while being deposited on the intermediary transfer belt 25 is removed by a belt cleaning device 30 by rubbing the intermediary transfer belt 25. The belt cleaning device 30 removes the secondary transfer residual toner by rubbing the intermediary transfer belt 25 with a cleaning blade.

The recording material S on which the four color images are secondary-transferred at the secondary transfer portion T2 is fed to a fixing device 31. The fixing device 31 melt-fixes the toner images on the recording material S under application of pressure by unshown rollers or belts or the like which oppose each other and under application of heat by a heat source (not shown) such as a heater in general. The recording material S on which the toner images are fixed by the fixing device 31 is discharged to an outside of the image forming apparatus 100.

To the developing device 1, a supplying device 32 is connected, and the developing device supplies the toner (supply agent specifically described later) to the developing device 1 in response to consumption of the toner by the developing device 1 with image formation. The developing device 1 is provided with a supply opening through which the supplying device 32 is connected and with a discharge opening through which an excessive developer generated with supply of the supply agent is discharged to an outside of the developing device 1 (FIG. 3).

<Developing Device>

The developing device 1 in this embodiment will be described using FIGS. 2 and 3. In this embodiment, the developing device 1 of the ACR type will be described as an example, but the developing device 1 may also be of a type other than the ACR type. The developing device 1 includes, as shown in FIG. 2, a developing container 2 forming a housing, a developing sleeve 3 as a developer carrying member, a regulating blade 5, a developing screw 13, a stirring screw 14, and the like.

In the developing container 2, a two-component developer containing a non-magnetic toner and a magnetic carrier is accommodated. In this embodiment, a two-component developing system is used as a developing system and the developer in which a negatively chargeable non-magnetic toner and a positively chargeable magnetic carrier are mixed is used. For example, the non-magnetic toner is obtained by incorporating a colorant, and a wax component or the like into a resin material such as polyester resin or styrene-acrylic resin, and is formed in a powdery form by pulverization or polymerization. To the surface of the powder, fine powder of titanium oxide, silica or the like is added. The magnetic carrier is obtained by coating a resin material on a surface layer of a core formed of ferrite particles or resin particles kneaded with magnetic powder. A toner content (ratio of a weight of the toner occupied in a total weight of the developer (TD ratio)) of the developer in a fresh (initial) state in which the developer has not been subjected to development of the electrostatic latent image is 8%, for example.

As shown in FIG. 2, the developing container 2 is open at a part thereof opposing the photosensitive drum 10 (FIG. 1), and the developing sleeve 3 as a developer carrying member is provided rotatably in the developing container 2 so as to be partly exposed through an opening of the developing container 2. The developing sleeve 3 is formed in a cylindrical shape using a non-magnetic material such as an aluminum alloy and is rotationally driven in an arrow R3 direction in FIG. 2. The developing sleeve 3 includes, at a surface thereof, a coated region M (carrying region, FIG. 3) where the developing sleeve 3 is capable of carrying the developer. Inside the developing sleeve 3, a magnet roller 4 constituted by a plurality of magnetic poles is provided nonrotatably.

The developing sleeve 3 rotates in the arrow R3 direction in FIG. 2, and carries and feeds, in a direction of the regulating blade 5, the developer attracted to the magnet roller 4 at a position of a scooping magnetic pole N1 of the magnet roller 4. The developer erected by a regulating magnetic pole S1 receives a shearing force by the regulating blade 5 when passing through a gap between the developing sleeve 3 and the regulating blade 5, so that an amount thereof is regulated and thus a developer layer having a predetermined layer thickness is formed on the developing sleeve 3. The formed developer layer is carried and fed to a developing region opposing the photosensitive drum 10 and develops the electrostatic latent image, formed on the surface of the photosensitive drum 10, in a state in which a magnetic chain of the developer is formed by a developing magnetic pole N2. The developer subjected to the development is peeled off the developing sleeve 3 by a non-magnetic band formed by adjacency of the same poles between a peeling magnetic pole N3 and the scooping magnetic pole N1.

In the developing container 2, a stirring chamber 12 as a first chamber and a developing chamber 11 as a second chamber are formed. Between the developing chamber 11 and the stirring chamber 12, a partition wall 15 for partitioning an inside of the developing container 2 into the developing chamber 11 and the stirring chamber 12 is provided. The partition wall 15 partitions the inside of the developing container 2 into the developing chamber 11 and the stirring chamber 12 by projecting from a bottom portion 2*c* of the developing container 2. The partition wall 15 extends in a rotational axis direction of the developing sleeve 3, so that the developing chamber 11 and the stirring chamber 12 are formed along the rotational axis direction of the developing sleeve 3.

<Screws>

As shown in FIG. 3, in the developing chamber 11, a developing screw 13 as a second screw feeding for feeding the developer in a predetermined second direction (arrow R4 direction) is provided. In the stirring chamber 12, a stirring screw 14 as a first feeding screw for feeding the developer in a first direction (arrow R5 direction) opposite to the second direction for the developing screw 13 is provided. The developing screw 13 and the stirring screw 14 are constituted by forming normally wound helical blades 13*b* and 14*b*, respectively, around rotation shafts 13*a* and 14*a*, respectively.

The developing sleeve 3, the developing screw 13 and the stirring screw 14 are constituted so as to be connection-driven by unshown gear trains, respectively, and are rotated by transmitting thereto a driving force from a driving motor 90 via the gear trains. A process speed can be switched by the driving motor 90 between a first speed and a second speed faster than the first speed. Therefore, in the case where the process speed is changed, the number of rotations of the developing screw 13 and the stirring screw 14 changes. In this embodiment, when the process speed is switched to the second speed, the number of rotations of the developing screw 13 and the stirring screw 14 increases. That is, the developing screw 13 and the stirring screw 14 rotate at a first number of rotations and a second number of rotations larger than the first number of rotations.

The partition wall 15 includes a first communication port 16 and a second communication port 17 each for establishing communication between the developing chamber 11 and the stirring chamber 12 on both longitudinal end sides with respect to the rotational axis direction of the stirring screw 14. The first communication port 16 is a developer delivering portion for permitting delivery of the developer from the stirring chamber 12 to the developing chamber 11 on a downstream side (with respect to the first direction), and the second communication port 17 is a developer delivering portion for permitting delivery of the developer from the developing chamber 11 to the stirring screw 12 on an upstream side (with respect to the first direction). Incidentally, herein, in the case where "upstream" or "downstream" is mentioned without being particularly specified, "upstream" or "downstream" refers to "upstream" or "downstream" with respect to the first direction which is a developer feeding direction of the stirring screw 14.

By rotation of the developing screw 13 and the stirring screw 14, the developer is circulated and fed in the developing container. At this time, the developer is delivered from the stirring chamber 12 to the developing chamber 11 through the first communication port 16 and is delivered from the developing chamber 11 to the stirring chamber 12 through the second communication port 17. As a result, a circulating path of the developer is formed in the developing container by the developing chamber 11 and the stirring screw 12, so that the developer is mixed and stirred by being circulated in the circulating path.

<Supply and Discharge of Developer>

Incidentally, in the developing device 1 for carrying out development with the two-component developer, not only an amount of the toner decreases with image formation, but also for example, a developing characteristic of the developer such that a charging performance of the carrier to the toner lowers can change. In the case where the charging performance of the carrier lowers, an image defect such as a density fluctuation or scattering fog can generate. Therefore, in order to restore the charging performance of the carrier, control for refreshing the carrier together with toner supply by supplying, for example, a supply agent, in which the toner and the carrier are mixed in a weight ratio of 9:1, from the supplying device 32 connected with the developing device 1 is carried out (so-called ACR type). Incidentally, a supply amount of the supply agent is determined in accordance with a detection result or the like of a toner content (concentration) in the developing container by an unshown toner content sensor.

As shown in FIG. 3, as regards the developing container 2, a supplying chamber 70 is formed at a position out of the developer circulating path of the stirring chamber 12 on a side upstream of the second communication port 17. The supplying chamber 70 communicates with the stirring chamber 12 and forms a supplying path of the supply agent to the stirring chamber 12. The supplying chamber 70 is provided with a supply opening 40 through which the supplying device 32 (FIG. 2) is connected with the supplying chamber 70. The supplying device 32 is omitted from illustration, but for example, a toner bottle accommodating the supply agent and a driving portion for rotating the toner bottle are provided and by rotating the toner bottle, the supply agent is supplied through an opening provided on the toner bottom via the supply opening 40. In the supplying chamber 70, a supplying screw 60 is provided. The supplying screw 60 feeds the developer in the supplying chamber 70 toward the stirring screw 12.

As described above, the supply agent is supplied by the supplying device 32, but when the amount of the developer becomes excessively large in the developing container with supply of the supply agent, stirring of the developer becomes insufficient, so that the image defect such as the density fluctuation or the scattering fog is liable to generate. Therefore, a discharge opening 50 for permitting discharge of an excessive developer due to supply of the supply agent to an outside of the developing container is formed in the developing container 2 so that the excessive developer is discharged through the discharge opening 50. The discharge opening 5 is formed on a side downstream of the first communication port 16 of the stirring chamber 12. This is because there is a liability that when the discharge opening 50 is formed, for example, on a wall surface at a halfway position of the stirring chamber 12, the developer is discharged more than necessary by raising with the stirring screw 14. In that case, the amount of the developer in the developing container becomes excessively small, so that the developer in a sufficient amount cannot be ensured on an upstream side of the developing screw 13 in the developing chamber 11 with respect to the second direction and thus it becomes difficult to uniformly coat the developer in the coated region M of the developing sleeve 3. When improper coating generates, density non-uniformity can generate on an output image. In order to avoid this, the discharge opening 50 is formed on a side, downstream of the first communication port 16, where the influence of the raising of the developer with the stirring screw 14 is small.

Incidentally, in recent years, in order to carry out printing of the image on a variety of recording materials by a single image forming apparatus, the process speed of the photosensitive drum 10 and the developing sleeve 3 is made variable. In this case, depending on a change of the process speed of the developing sleeve 3, also the number of rotations of the developing screw 13 and the stirring screw 14 is changed as described above. However, in the conventional developing device, in the case where the number of rotations of the developing screw 13 and the stirring screw 14 is increased, delivery of the developer through the first communication port 16 and the second communication port 17 was unable to be sufficiently carried out. This is because when a developer feeding property in the rotational axis direction increases in proportion to the number of rotations of the developing screw 13 and the stirring screw 14, a peak of a developer surface height of the developer shifts toward a downstream side at the first communication port 16 and shifts toward an upstream side at the second communication port 17. Then, the peak of the developer surface height of the developer is out of the first communication port 16 and the second communication port 17, so that the amount of the developer delivered through the first communication port 16 and the second communication port 17 decreases, i.e., a developer delivering property lowers.

When the developer delivering property lowers, the developer stagnates on a downstream side of the developing chamber 11 with respect to the second direction or is discharged through the discharge opening 50 formed on a downstream side of the stirring chamber 12. In such a case, there is a liability that the stagnated developer overflows the developing container 2 or that the developer in a sufficient amount cannot be ensured in the developing chamber 11 on an upstream side of the developing screw 13 with respect to the second direction and thus the image defect is caused. Therefore, in order to maintain the developer delivering property through the first communication port 16 and the second communication port 17 without being influenced by the number of rotations of the developing stirring chamber 13 and the stirring screw 14, in this embodiment, constitutions of the developing stirring chamber 13 and the stirring screw 14 are different from conventional constitutions. In the following, for easy understanding of explanation, description will be made by taking the stirring screw 14 as an example.

<Stirring Screw>

The stirring screw 14 will be described with reference to FIGS. 3 and 4. As shown in FIG. 3, the stirring screw 14 as a feeding screw includes a feeding portion (first feeding portion) 141 where a normally wound helical blade 14*b* as a first blade is formed and includes a returning (feeding) portion (second feeding portion) 142 where a reversely wound helical blade as a second blade is formed. That is, around the rotation shaft 14*a* of the stirring screw 14, in addition to the helical blade 14*b*, a helical blade 14*c* for feeding the developer in an opposite direction (second direction) to the developer feeding direction of the helical blade 14*b*. In this embodiment, the helical blade 14*b* and the helical blade 14*c* are formed so that a downstream end of the helical blade 14*b* and an upstream end of the helical blade 14*c* substantially coincide with each other with respect to the longitudinal direction.

The stirring screw 14 is disposed so that the returning portion 142 is positioned upstream of the discharge opening 50 and so that an upstream end 142*a* of the returning portion 142 is positioned downstream of an upstream end 16*a* of the first communication port 16 and upstream of a downstream end 16*b* of the first communication port 16. That is, the upstream end 142*a* of the returning portion 142 overlaps with the first communication port 16 with respect to the longitudinal direction. Incidentally, a longitudinal length of the returning portion 142 may preferably be set at, for example, 10-40 mm, more preferably be set at 20 mm or more and 30 mm or less.

Figure 4:
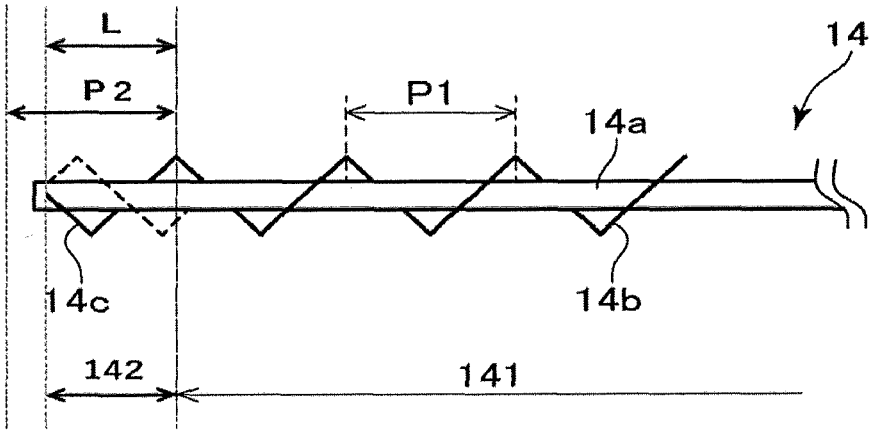
FIG. 4 is a schematic view for illustrating a feeding portion and a returning (feeding) portion.

As shown in FIG. 4, as regards the stirring screw 14, a pitch (or lead) of the helical blade 14*b* of the feeding portion 141 is "P1" (mm), a lead of the helical blade 14*c* of the returning portion 142 is "P2" (mm). Further, the number of threads of the helical blade 14*c* is "n" and a length of the helical blade 14*c* with respect to the first direction (a length of the returning portion 142 with respect to the longitudinal direction) is "L" (mm). In that case, in this embodiment, the stirring screw 14 is formed so as to satisfy the following formulas 1 and 2.

$$P2 \geq P1 \quad \text{formula 1}$$

$$n \times L > P2 (n \geq 2) \quad \text{formula 2}$$

The formula 1 represents that the pitch of the helical blade 14*c* is equal to or more than the pitch of the helical blade 14*b*. In this embodiment, the respective leads of the helical blade 14*c* and the helical blade 14*b* may only be required to be set so that a developer feeding amount per (one) rotation of the helical blade 14*c* is not less than a developer feeding amount per (one) rotation of the helical blade 14*b*.

Figure 5:
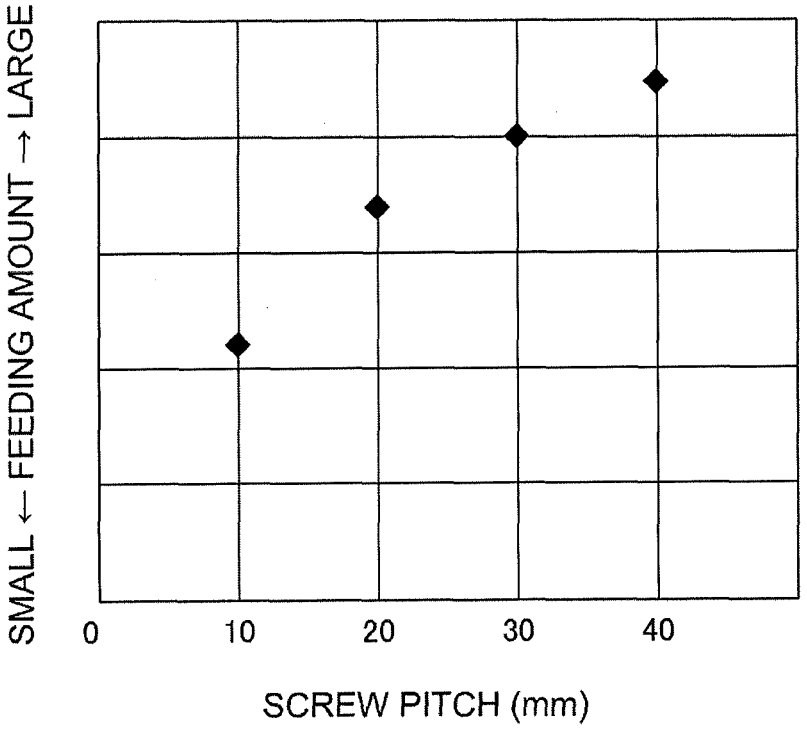
FIG. 5 is a graph showing a relationship between a pitch of a helical blade and a developer feeding amount per (one) rotation of a screw.

FIG. 5 shows a relationship between a pitch of a general helical blade and a developer feeding amount per rotation by the helical blade. As an example, the case where a screw outer diameter is 20 mm is cited. As can be understood from FIG. 5, the developer feeding amount per rotation varies depending on the pitch. In this example, the developer feeding amount per rotation is maximum when the helical blade pitch is 40 mm. The pitch of the helical blade 14*b* is preferred since the feeding property of the developer in the longitudinal direction is best when the developer feeding amount per rotation is maximum. Therefore, the pitch of the helical blade 14*b* is set at 40 mm, for example.

However, in the case where the developer feeding property in the longitudinal direction is made best by making the developer feeding amount per rotation maximum, it is not preferable that an amount of the developer delivered through the first communication port 16 (hereinafter referred to as a delivery amount) relatively decreases. If as in the conventional constitution, a relationship of "P2<P1" holds, the developer feeding amount per rotation is larger in the case of the helical blade 14*b* than in the case of the helical blade 14*c*, so that particularly in the case where the number of rotations of the stirring screw 14 is increased, the delivery amount can decrease. Therefore, in this embodiment, the helical blade 14*c* is formed so as to further satisfy the above-described formula 2.

In this embodiment, as shown in FIG. 3, the upstream end 142*a* of the returning portion 142 overlaps with the first communication port 16 with respect to the longitudinal direction. In other words, the stirring screw 14 is disposed so that a boundary (the upstream end 142*a*) between the helical blade 14*b* and the helical blade 14*c* is positioned downstream of the upstream end 16*a* of the first communication port 16 and downstream of the downstream end 16*b* of the first communication port 16. In that case, at a position of the stirring screw 14 opposing the first communication port 16, as flows of the developer, a flow in the first direction by the helical blade 14*b*, a flow in the second direction by the helical blade 14*c* and a flow in a direction which crosses the longitudinal direction and which is oriented toward the first communication port 16 exists in mixture. Particularly, in the case where the helical blade 14*c* is formed in multiple threads, the developer fed by the helical blade 14*c* is fed in the second direction in contact with the helical blade 14*c* plural times per rotation at the same longitudinal position. Thus, the flow of the developer in the second direction by the helical blade 14*c* can become strong depending on an increasing number of rotations of the stirring screw 14. For that reason, even when the developer feeding property by the helical blade 14*b* is enhanced by increasing the number of rotations of the stirring screw 14, a balance thereof with the developer feeding property by the helical blade 14*c* can be maintained similarly as before the increase of the number of rotations, i.e., before the change of the number of rotations. Further, when the pitch of the helical blade 14*c* is equal to or more than the pitch of the helical blade 14*b*, the developer feeding property by the helical blade 14*c* can be easily enhanced. That is, the flow of the developer in the direction toward the first communication port 16 is easily maintained.

The above-described formula 2 is a condition for existence of the helical blade 14*c* at any position of the returning portion 142 with respect to a circumferential direction of the rotation shaft 14*a* as seen in the rotational axis direction of the stirring screw 14. In a preferred example, the helical blade 14*c* with two or more threads exists, and therefore, the helical blade 14*c* may preferably be formed in multiple threads, and is formed in four threads, for example. That is, the returning portion 142 includes a multiple-thread screw. This is because in the case where the number of rotations of the stirring screw 14 is increased, the developer is prevented from being raised by centrifugal force of the helical blade 14*b* to a level higher than a level before the number of rotations is increased.

That is, ease of raising of the developer varies depending on characteristics of the screw, specifically the pitch and the number of threads of the helical blade. In the case where the pitch of the helical blade is large, compared with the case where the pitch of the helical blade is small, the amount of the developer fed per rotation increases. However, an angle of the helical blade approaches horizontally, and therefore, the amount of the developer fed per rotation increases. On the other hand, in the case where the number of threads of the helical blade is small, compared with the case where the number of threads of the helical blade is large, the amount of the developer fed by the helical blade increases and is liable to increase in amount of the developer raised correspondingly thereto.

The raising of the developer does not readily generate when the amount of the fed developer is large and is liable to generate when the amount of the fed developer is small. Further, in the case where the amount of the developer in the developing container is small, when the raising of the developer generates in the neighborhood of the discharge opening 50, the developer is excessively discharged through the discharge opening 50 and thus the amount of the developer in the developing container becomes excessively small. Then, the developer in a sufficient amount is not readily supplied to the developing sleeve 3, so that an output image can cause density non-uniformity. Therefore, in order to prevent a lowering in feeding property of the developer in the longitudinal direction, the helical blade 14*b* may preferably be formed in a single thread. That is, the helical blade 14*b* may desirably be formed with a large pitch in a small number of threads in general in order to increase the amount of the developer fed per rotation. In that case, also the lead of the helical blade 14*c* may desirably be increased. However, the number of threads of the helical blade 14*c* is kept at a single thread, the raising of the developer is liable to generate in the neighborhood of the discharge opening 50, so that discharge of the developer through the discharge opening 50 can be accelerated. Therefore, in order to prevent an excessive decrease in amount of the developer in the developing container, the helical blade 14*c* may preferably be formed in multiple threads. In the case where the helical blade 14*c* is formed in multiple threads, in addition to the above-described formulas 1 and 2, the following formula 3 may only be required to be further satisfied.

$$L \leq P2 \qquad \text{formula 3}$$

According to the constitution of the stirring screw 14 satisfying the above-described formulas 1 and 2, the developer surface height of the developer becomes maximum (i.e., a peak) at a boundary between the feeding portion 141 and the returning portion 142. Then, the developer delivering property through the first communication port 16 is preferred since a delivering efficiently becomes high in the case where the boundary between the feeding portion 141 and the returning portion 142 with respect to the longitudinal direction is positioned in an opposing region to the first communication port 16. Therefore, in this embodiment, as described above, the stirring screw 14 is disposed in the stirring chamber 12 so that the upstream end 142*a* of the returning portion 142 overlaps with the first communication port 16 with respect to the longitudinal direction.

<Coated Region>

As described above, the amount of the developer delivered from the stirring chamber 12 to the developing chamber 11 through the first communication port 16 becomes maximum at the boundary between the feeding portion 141 and the returning portion 142, i.e., at the upstream end 142*a* of the returning portion 142 (FIG. 3), but remarkably decreases on a side downstream of the boundary. That is, the developer delivered to the developing chamber 12 is fed in the second direction by the developing screw 13. For that reason, the developer surface height of the developer in the developing chamber 11 lowers on a side upstream of the boundary with respect to the second direction (i.e., on a side downstream of the boundary with respect to the first direction). At a position where the developer surface height of the developer in the developing chamber 11 is low, the developer is not readily supplied to the developing sleeve 3.

In view of the above-described point, in this embodiment, the developing sleeve 3 is disposed in the developing container 2 so that a downstream end 3*a* of the coated region M of the developing sleeve 3 is in a position, between a side upstream of the boundary (142*a*) and the upstream end 16*a* of the first communication port 16, where the developer surface height is relatively stable. The downstream end 3*a* of the coated region M is disposed at the above-described position where the developer surface height is relatively stabilized easily, so that the developer can be sufficiently supplied from the developing screw 13 to the developing sleeve 3. That is, the coated region M of the developing sleeve 3 is uniformly coated, and therefore, an image defect due to improper coating does not readily generate.

<Experimental Result>

The present inventors conducted an experiment for measuring the developer surface height of the developer. In the experiment, 250 g of the developer was placed in the developing container 2, and the developing sleeve 3, the developing screw 13 and the stirring screw 14 were continuously rotated for 5 minutes until the developer surface height was stabilized. After a lapse of 5 minutes, rotations of these members were stopped, an upper cover of the developing container 2 was removed, and then the developer surface height of the developer was measured at the first communication port 16 by using a laser displacement meter (gage) ("LJ-G080", manufactured by KEYENCE Corp.). The developer surface height of the developer is a height from a bottom of the developing container 2 at the first communication port 16. The experiment was conducted while changing the pitch "P2" of the helical blade 14*c*, the first direction length "L" of the helical blade 14*c*, the number of threads "n" of the helical blade 14*c* (see the formulas 1 and 2) and the number of rotations of the stirring screw 14 in the case where the pitch of the helical blade 14*b* was 40 mm. In this experiment, the pitch of the helical blade 14*c* was set at "20 mm" and "40 mm", the longitudinal length of the returning portion 142 was set at "5 mm", "10 mm" and "20 mm", and the number of threads of the helical blade 14*c* was set at "one thread", "two threads" and "four threads". Further, the number of rotations of the stirring screw 14 was 300 rpm during a low-speed state and was 600 rpm during a high-speed state.

Experimental results are shown in Tables 1 and 2 appearing thereinafter. Table 1 shows the experimental result in the case where the pitch of the helical blade 14*c* is 20 mm, and Table 2 shows the experimental result in the case where the pitch of the helical blade 14*c* is 40 mm. In Tables 1 and 2, numerical values for the number of threads n represent average developer surface heights (mm)(left side: during low-speed state/light side: during high-speed state). Further, "x" represents that the developer surface height is out of a tolerance range during both of the low-speed state and the high-speed state, "Δ" represents that the developer surface height is out of the tolerable range during the high-speed state, and "○" represents that the developer surface height falls within the tolerable range during both of the low-speed state and the high-speed state. An opening height of the first communication port 16 was 30 mm, and in this experiment, when the average developer surface height was less than 24 mm which is 80% of the opening height, the developer delivering property through the first communication port 16 was evaluated as good ("○", within the tolerable range).

TABLE 1

| | | n | | |
|---|---|---|---|---|
| P2 = 20(mm) | | 1 | 2 | 4 |
| L(mm) | 5 | 26/32 x | 25/30 x | 25/30 x |
| | 10 | 26/30 x | 23/29 Δ | 22/27 Δ |
| | 20 | 24/26 x | 21/25 Δ | 20/25 Δ |

TABLE 2

| | | n | | |
|---|---|---|---|---|
| P2 = 40(mm) | | 1 | 2 | 4 |
| L(mm) | 5 | 25/31 x | 24/31 x | 24/30 x |
| | 10 | 24/27 x | 22/27 Δ | 20/23 ○ |
| | 20 | 24/27 x | 20/21 ○ | 15/20 ○ |

Figure 6:
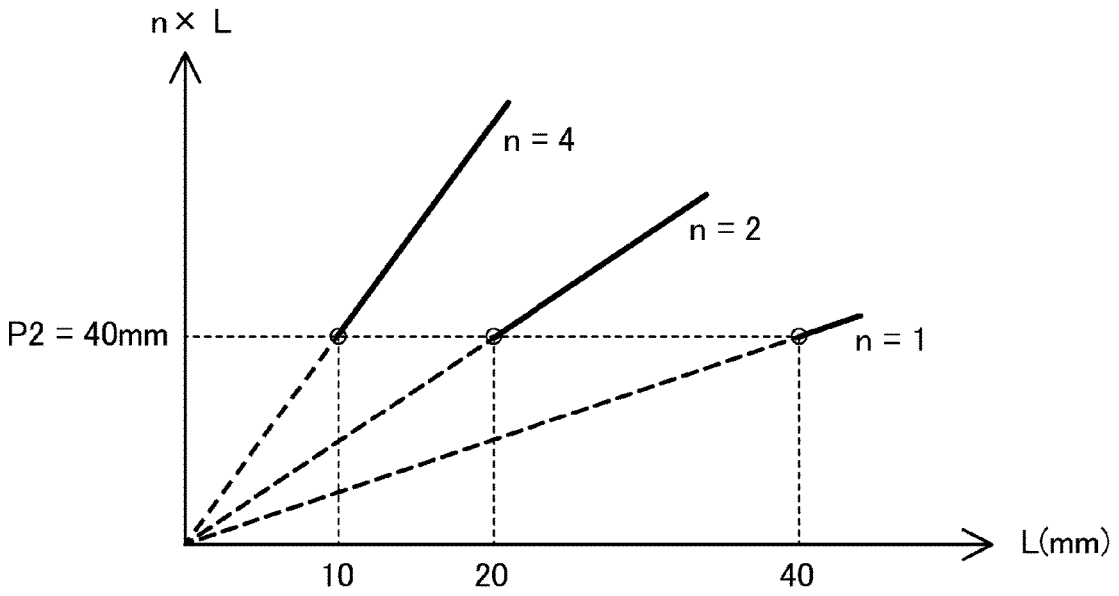
FIG. 6 is a graph showing a relationship of "$n \times L > P2$" in the case where the number of threads n of a reversely wound helical blade and a length of the helical blade with respect to a first direction are changed.

Before explanation of the experimental results, a relationship among the pitch "P2" of the helical blade 14*c*, the number of threads "n" of the helical blade 14*c* and the first direction length "L" of the helical blade 14*c*, which satisfies the above-described formula 2, i.e., "n×L>P2" is shown in FIG. 6. In FIG. 6, the abscissa represents "L", and the ordinate represents "n×L", and the case where the number of threads "n" is 1, 2 and 4 was shown. Further, the case where the pitch "P2" is 40 mm is shown as an example, and a range of "n×L≤P2" which does not satisfy the above-described formula 2 is indicated by a broken line and a range satisfying the above-described formula 2 is indicated by a solid line. In the case where the pitch "P2" of the helical blade 14*c* is 40 mm, as can be understood from FIG. 6, when the number of threads "n" of the helical blade 14*c* is 4 (four threads), the first direction length "L" of the helical blade 14*c* may only be required to be larger than 10 mm. When the number of threads "n" of the helical blade 14*c* is 2 (two threads), the first direction length "L" of the helical blade 14*c* may only be required to be larger than 20 mm. When the number of threads "n" of the helical blade 14*c* is one (single thread), the first direction length "L" of the helical blade 14*c* may only be required to be larger than 40 mm. That is, when the number of threads "n" of the helical blade 14*c* can be increased, the first direction length "L" of the helical blade 14*c* may be shortened.

As shown in Table 1, in the first place, in the case where the above-described formula 1 is not satisfied, even when any setting is made as the number of threads "n" of the helical blade 14*c* and the first direction length "L" of the helical blade 14*c*, it is difficult to improve the developer feeding property during the low-speed state and during the high-speed state. That is, in the case where the pitch of the helical blade 14*c* is smaller than the pitch of the helical blade 14*b*, the developer feeding amount per rotation is larger in the case of the helical blade 14*b* than in the case of the helical blade 14*c*. When the number of rotations of the stirring screw 14 is increased, the developer feeding amount per rotation of the helical blade 14*b* is larger than the developer feeding amount per rotation of the helical blade 14*c*. Then, the developer passes through a portion opposing the first communication port 16 in the longitudinal direction, so that the developer is not readily delivered from the stirring chamber 12 to the developing chamber 11. Therefore, as described above, in this embodiment, first, the relationship "P2≥P1" (formula 1) is satisfied.

On the other hand, as shown in Table 2, in the case where the above-described formula 1 is satisfied and the above-described formula 2 is further satisfied, the developer surface height is lower than the developer surface height in the case where the above-described formula 2 is not satisfied. This means that the developer delivering property through the first communication port 16 is satisfactorily maintained. Incidentally, in the example shown in Table 2, in the case where the number of threads of the helical blade 14*c* is 4 (four threads) and the length of the returning portion 142 with respect to the longitudinal direction is 20 mm, the developer surface height is lowest. That is, the developer delivering property through the first communication port 16 was best.

The present inventors conducted, as another experiment, a durability test by the image forming apparatus. First, the developer in an amount (280 g in this case) in which density non-uniformity and overflow of the developer and the like do not generate, and then the experiment was started. In this experiment, image formation in which an image with an image density of 1% was formed on 1000 sheets of the recording material was carried out and the recording material subjected to the image formation was observed by eyes, so that occurrence or non-occurrence of image non-uniformity (image defect) was checked. Further, after an end of the image formation, the developing device 1 was taken out and then the developer amount in the developing container was measured. The experiment was conducted under a condition that in the case where the pitch "P1" of the helical blade 14*b* is 30 mm, the pitch "P2" of the helical blade 14*c*, the first direction length "L" of the helical blade 14*c*, the number of threads "n" of the helical blade 14*c* (see the above-described formulas 1 and 2), and the number of rotations of the stirring screw 14 were changed.

An experimental result is shown in Table 3 appearing hereinafter. In Table 3, "○" represents that the image defect did not generate on all of the 1000 sheets of the recording material, and "x" represents that the image defect generated. In Table 3, numerical values in parentheses indicated immediately on the right side of "x" represent that the image non-uniformity starts to generate from the indicated numerical values. Incidentally, also as regards Comparison Examples 1 to 3 in which the above-described formula 2 is not satisfied, the experiment was conducted and an experimental result of Comparison Examples 1 to 3 was also shown in Table 3 for comparison.

TABLE 3

| | P2 | L | n | PS*1 | DA*2 | OI*3 |
|---|---|---|---|---|---|---|
| EMB. 1 | 30 | 40 | 1 | LOW | 270 g | ○ |
| | | | | HIGH | 245 g | ○ |
| EMB. 2 | 30 | 10 | 4 | LOW | 270 g | ○ |
| | | | | HIGH | 245 g | ○ |
| COMP. EX. 1 | 45 | 10 | 4 | LOW | 250 g | ○ |
| | | | | HIGH | 220 g | x(650) |
| COMP. EX. 2 | 30 | 5 | 4 | LOW | 250 g | ○ |
| | | | | HIGH | 220 g | x(700) |
| COMP. EX. 3 | 30 | 10 | 1 | LOW | 250 g | ○ |
| | | | | HIGH | 190 g | x(500) |

*1"PS" is the process speed.
*2"DA" is the developer amount.
*3"OI" is the output image.

As can be understood from Table 3, even in any case of this embodiment (Embodiment 1) and Comparison Examples 1 to 3, during the low-speed state, the image defect did not generate. On the other hand, during the high-speed state, the image defect did not generate in this embodiment, but generated on the 650th sheet and later in Comparison Example 1, the 700th sheet and later in Comparison Example 2, and the 500th sheet and later in Comparison Example 3. That is, as in Comparison Examples 1 to 3, in the case where the above-described formula 2 is not satisfied, compared with the case where the above-described formula 2 is satisfied, the amount of the developer which can be pushed back by one rotation of the helical blade 14*c* is small. Therefore, when the number of rotations of the stirring screw 14 increases, a degree of discharge of the developer through the discharge opening 50 becomes excessive, so that the developer amount in the developing container gradually decreases. Then, when the number of sheets subjected to the durability test is a certain value or more, the amount of the developer in the developing container becomes excessively small and thus the developer in a sufficient amount cannot be ensured on an upstream side of the developing screw 13 in the developing chamber 11 with respect to the second direction, so that the developer is not readily coated uniformly in the coated region M of the developing sleeve 3. When improper coating generates, image non-uniformity generates on the output image. On the other hand, in the case where the above-described formulas 1 and 2 are satisfied as in this embodiment, compared with the case where the above-described formula 2 is not satisfied, irrespective of the number of rotations, the amount of the developer pushed back by one rotation of the helical blade 14*c* is substantially equal to the amount of the developer fed by the helical blade 14*b*. For that reason, even when the number of rotations of the stirring screw 14 is increased, the developer is not excessively discharged through the discharge opening 50.

As described above, in this embodiment, the stirring screw 14 is formed so that the relationships of "P2≥P1" (formula 1) and "n×L>P2" (formula 2) are satisfied at the feeding portion 141 and the returning portion 142. In the case where the above-described formula 1 is satisfied and the above-described formula 2 is further satisfied, the developer feeding amount per rotation is unchanged irrespective of the number of rotations of the stirring screw 14, and therefore, the delivery of the developer through the first communication port 16 is satisfactorily maintained during the low-speed state and during the high-speed state. That is, even when the number of rotations of the stirring screw 14 changes, the developer feeding amount per rotation of the stirring screw 14 is substantially the same between the helical blade 14*b* and the helical blade 14*c*. In such a case, a peak of the developer surface height of the developer does not readily shift toward a downstream state at the first communication port 16, so that the delivery of the developer from the stirring chamber 12 and the developing chamber 11 through the first communication port 16 is smoothly carried out, and therefore, the developer is not readily sent toward the downstream end 16*b* side of the first communication port 16. Therefore, as described above, the developer is not excessively discharged through the discharge opening 50, so that the density non-uniformity due to an excessive decrease of the developer in the developing container can be made hard to generate.

Further, the helical blade 14*c* is formed in multiple threads, so that a frequency of pushing-back of the developer per one rotation can be increased. In this case, the delivery of the developer is satisfactorily maintained, and in addition, the first direction length "L" (longitudinal length of the returning portion 142) of the helical blade 14*c* can be shortened. That is, the developing device 1 can be formed in a compact state with respect to the longitudinal direction.

Second Embodiment

Figure 7:
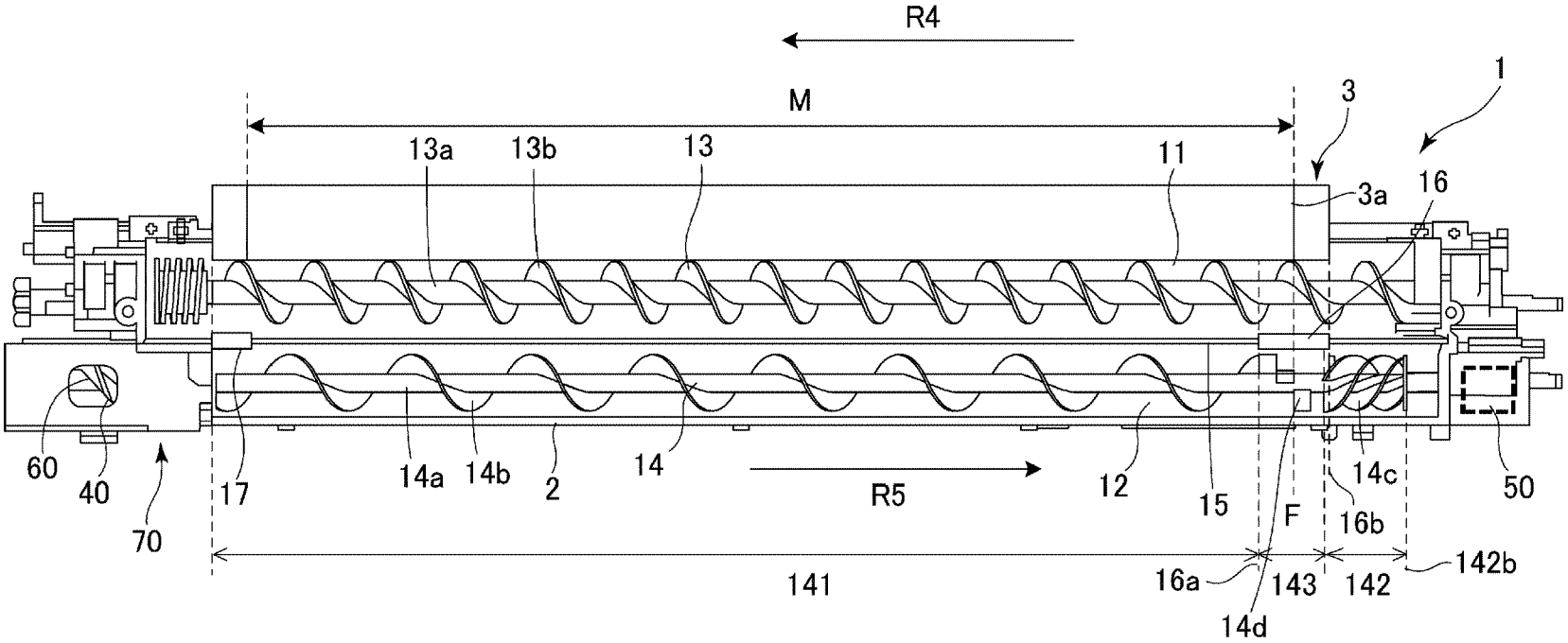
FIG. 7 is a top plan view of a developing device of a Second Embodiment.

In the above-described First Embodiment, the stirring screw 14 in which the helical blade 14*c* is continuously formed with no gap on a side downstream of the helical blade 14*b* with respect to the longitudinal direction was described as an example. On the other hand, in this embodiment (Second Embodiment) shown in FIG. 7, a gap (spacing) portion 143 where the helical blade is not formed is provided at a portion, opposing the first communication port 16, between the normally wound helical blade 14*b* and the reversely wound helical blade 14*c*. However, in the gap portion 143, a paddle 14*d* as a plate-like member which projects from the rotation shaft 14*a* in a radial direction and which extends in the first direction is formed. Further, a downstream end 142*b* of the returning portion 142 is positioned downstream of the downstream end 16*b* of the first communication port 16 and upstream of the discharge opening 50. Other constitutions and actions are similar to those of the above-described First Embodiment, and therefore, the same constituent elements are represented by the same reference numerals or symbols and will be described. Incidentally, the gap portion 143 is formed so that a first direction length thereof is shorter than the first direction length "L" of the helical blade 14*c*, and is formed in length of 5 mm or more and 20 mm or less, for example.

In the case of this embodiment, the developer fed in the stirring chamber 12 to the gap portion 143 by the helical blade 14*b* is decelerated at the gap portion 143 and is pushed back by the helical blade 14*c*. For that reason, the developer surface height of the developer easily becomes maximum at the gap portion 143 (specifically at an intermediary position F). Further, in order to deliver the developer from the stirring chamber 12 to the developing chamber 11 through the first communication port 16, the gap portion 143 is provided with a plurality of paddles 14*d* (four paddles as an example).

<Paddles>

The paddles will be described using parts (a) and (b) of FIG. 8. Paddles 14*da* to 14*dd* are disposed so as not to overlap with each other with respect to a circumferential direction and a rotational axis direction of the rotation shaft 14*a*. In the case of this embodiment, the four paddles 14*da* to 14*dd* are disposed so that phases thereof are deviated 90° from each other with respect to the circumferential direction of the rotation shaft 14*a*. Incidentally, a direction of the phase deviation may desirably be a direction in which the thread of the helical blade 14*b* is wound. This is because if the paddles 14*da* to 14*dd* are disposed while deviating phases thereof with respect to a direction opposite to the direction in which the thread of the helical blade 14*b* is wound, the developer fed by the helical blade 14*b* collides with the developer raised by the paddles 14*da* to 14*dd*, and thus raising of the developer easily occurs. In such a case, it becomes difficult to efficiently deliver the developer from the stirring chamber 12 to the developing chamber 11. On the other hand, when the phases of the paddles 14*da* to 14*dd* are deviated in the same direction as the direction in which the thread of the helical blade 14*b* is wound, the developer successively contacts the developer on the paddles 14*da* to 14*dd*, and therefore, the above-described collision of the developers does not occur. For this reason, the developer can be efficiently delivered from the stirring chamber 12 to the developing chamber 11. Further, in the case of this embodiment, the upstreammost paddle 14*da* is connected with the helical blade 14*b* with no gap, and similarly, the downstreammost paddle 14*dd* is connected with the helical blade 14*b* with no gap.

Also in this embodiment, similarly as the above-described First Embodiment, the stirring screw 14 is formed so as to satisfy the relationships of the above-described formulas 1 and 2. Therefore, the developer feeding amounts per rotation by the helical blades 14*b* and 14*c* are substantially equal to each other, and in addition, by reduction of the feeding speed by the gap portion 143 and improvement of delivering efficiency by the paddles 14*d*, the developer delivering property can be satisfactorily maintained even when the number of rotations changes.

As shown in FIG. 9, according to the above-described constitution of the stirring screw 14, the developer feeding amounts per rotation of the developers fed by the helical blades 14*b* and 14*c* are substantially equal to each other, and therefore, the developer is delivered principally at the substantially intermediary position F of the gap portion 143. Accordingly, when the first communication port 16 is in an opposing region including at least the gap portion 143, the delivering efficiency of the developer can be more enhanced. Further, in order to enhance the developer delivering efficiency by the helical blades 14*b* and 14*c*, it is preferable that the gap portion 143 and the first communication port 16 are formed in substantially the same longitudinal length and are disposed so as to oppose each other over an entirety of a longitudinal region.

<Coated Region>

In the case of this embodiment, the developer surface height at the gap portion 143 is maximum at the substantially intermediary position F, and therefore, the amount of the developer delivered from the stirring chamber 12 to the developing chamber 11 is maximum at the substantially intermediary position F. Then, the developer delivered to the developing chamber 11 is fed by the developing screw 13 in the second direction, i.e., toward the upstream side of the first direction. Accordingly, the developer surface height at the gap portion 143 in the developing chamber 11 abruptly lowers on a side upstream, with respect to the first direction (downstream with respect to the first direction), of the substantially intermediary position. When the developer surface height is excessively low in the developing chamber 11, it becomes difficult to stably supply the developer to the developing sleeve 3. In view of this, the coated region M of the developing sleeve 3 is disposed or a side, with respect to the first direction, upstream of at least the substantially intermediary position F, of the gap portion 143, where the developer surface height is stable. In this embodiment, the downstream end 3*a* of the coated region M is caused to coincide with the substantially intermediary position F.

As described above, the downstream end 3*a* of the coated region M may be disposed upstream of the substantially intermediary position F with respect to the first direction, but when the downstream end 3*a* of the coated region M is positioned downstream of the downstream end 16*b* of the first communication port 16, a developer circulation path becomes long, and therefore, the amount of the developer fed per unit time can lower. In that case, particularly in such a case that an image with a high image ratio is formed, there is a liability that the toner density is not readily stabilized with respect to the longitudinal direction. Further, when the developer circulating path is long, even when the developer is supplied, it takes such time until the toner density is stabilized. In order to compensate for this, the developer amount in the developing container may preferably be increased, but the increased developer amount leads to an increase in cost, and therefore it is difficult to employ the increased developer amount. Therefore, in this embodiment, the downstream end 3*a* of the coated region M may preferably be disposed downstream of the upstream end 16*a* of the first communication port 16 and upstream of the substantially intermediary position F.

<Experiment Result>

The present inventors connected an experiment in which a coating amount of the developer on the developing sleeve was measured. In the experiment, in order to evaluate the coating amount of the developer with respect to the longitudinal direction of the developing sleeve 3, a line camera ("Spyder 3 (SG-10-02K), manufactured by TELEDYNE DALSA Corp.) was used. A lens is made by Nikon Corp. (50 mm, f/1.4 G), and a light source is a high luminance broad linear illumination device (white LED) manufactured by AITEC SYSTEM Co., Ltd. A shooting speed was 1000 fps, and an exposure time was 1/1000s. In the developing container 2, 250 g of the developer was placed, and the developing sleeve 3, the developing screw 13 and the stirring screw 14 were continuously rotated 5 minutes until the developer surface is stabilized. After a lapse of 5 minutes, luminance of the developer carried on the developing sleeve 3 was measured by the line camera, so that a distribution of the coating amount was measured. In this experiment, the developing screw 13 and the stirring screw 14 were rotated at 600 rpm, and the developing sleeve 3 was rotated at 500 rpm. Further, as a comparison example, the experiment was conducted also for the case where the downstream end 3*a* of the coated region M was caused to substantially coincide with the downstream end 16*b* of the first communication port 16.

An experimental result is shown in FIG. 10. In FIG. 10, the ordinate represents the coating amount converted from a luminance value of the line camera, and the abscissa represents a longitudinal position from the downstream end 3*a* of the coated region M toward the upstream side with respect to the first direction. A solid line represents the experimental result of this embodiment, and a broken line represents the experimental result of the comparison example. As can be understood from FIG. 10, in the case of the comparison example, the developer surface height in the neighborhood of the downstream end 3*a* of the coated region M in the developing chamber 11 becomes low, and therefore, the coating amount of the developer at the downstream end 3*a* remarkably lowers. On the other hand, in the case of this embodiment, the developer surface height in the neighborhood of the downstream end 3*a* can be ensured so as to be sufficiently high, and therefore, the coating amount is uniformly maintained over the longitudinal direction of the coated region M without being lowered.

Also in the case of this embodiment, the delivery of the developer through the first communication port 16 is satisfactorily maintained during the low-speed state and during the high-speed state. Accordingly, an effect similar to the above-described effect of the First Embodiment such that the density non-uniformity due to the excessive decrease of the developer in the developing container does not readily generate can be obtained.

Third Embodiment

In the above-described embodiments, the constitution of the stirring screw 14 was made different from the conventional constitution, but the present invention is not limited thereto, and the constitution of the developing screw 13 may also be made different from the conventional constitution. The case where not only the constitution of the stirring screw 14 but also the constitution of the developing screw 13 are made different from the conventional constitutions is shown in FIG. 11. In Third Embodiment, the developing stirring chamber 13 is formed similarly as in the above-described stirring screw 14.

<Developing Screw>

As shown in FIG. 11, the developing screw 13 includes a second feeding portion 111 where a normally wound helical blade 13*b* as a third blade is formed and includes a second returning portion 112 where a reversely wound helical blade 13*c* as a fourth blade is formed. The helical blade 13*b* feeds the developer in the second direction (arrow R4 direction), and the helical blade 13*c* feeds the developer in the first direction (arrow R5 direction). Further, in this embodiment, a gap portion 113 where the helical blade is not formed is provided at a portion, between the helical blade 13*b* and the helical blade 13*c*, opposing the second communication port 17, but may also be not provided. Further, the paddles may also be not formed at the gap portion 113.

The developing stirring chamber 13 is formed so that with respect to the second direction, an upstream end of the helical blade 13*c* is disposed between an upstream end and a downstream end of the second communication port 17. Further, the developing screw 13 is formed so that a pitch "P3" of the helical blade 13*b*, a pitch "P4" of the helical blade 13*c*, the number of threads "nA" of the helical blade 13*c* and a second direction length "LA" of the helical blade 13*c* satisfy the following formulas 4 and 5.

$$P4 \geq P3 \qquad \text{formula 4}$$

$$nA \times LA > P4 \qquad \text{formula 5}$$

In the case of this embodiment, the developer delivering property through the first communication port 116 is satisfactorily maintained, and in addition, the developer delivering property through the second communication port 17 is satisfactorily maintained. According to this, stagnation of the developer is suppressed in the developing container, and therefore, an effect such that the developer overflows the developing container 2 and contaminates an inside of the apparatus main assembly can be obtained. It is also possible to achieve such an effect that the density non-uniformity due to the excessive decrease of the developer in the developing container does not readily generate.

Incidentally, the developing screw 13 and the stirring screw 14 may preferably be the same. That is, these screws may preferably be formed so that the pitches of the reversely wound helical blades, the pitches of the normally wound helical blades, the numbers of threads of the helical blades, and the lengths of the reversely wound helical blades with respect to the longitudinal direction are the same. In that case, the amount of the developer delivered through the first communication port 16 and the amount of the developer delivered through the second communication port 17 can be made substantially equal to each other, so that localization of the developer in one of the developing chamber 11 and the stirring chamber 12 can be prevented.

Other Embodiments

In the above-described embodiments, the screw in which the normally wound helical blade and the reversely wound helical blade were provided on the same rotation shaft was described, but the present invention is not limited thereto. For example, a constitution in which an upstream screw formed with the normally wound helical blade and a downstream screw formed with the reversely wound helical blade are provided separately, and these screws are rotated in directions opposite to each other may also be employed.

In the above-described embodiments, the developing device of the horizontal stirring type in which the developing container 2 is partitioned horizontally into the developing chamber 11 and the stirring chamber 12 was described as an example, but the present invention is not limited thereto. That is, the above-described embodiments are also applicable to a developing device of a vertical stirring type in which the developing container 2 is partitioned vertically into the developing chamber 11 and the stirring chamber 12, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100859 filed on May 22, 2017, which is hereby incorporated by reference herein in its entirety.

What is claimed is:

1. A developing device, comprising:

a developer carrying member configured to carry a developer containing toner and a carrier for developing an electrostatic latent image formed on an image bearing member;

a developing container including a first chamber and a second chamber partitioned from said first chamber by a partition wall and configured to accommodate the developer;

a first communicating portion configured to permit movement of the developer from said first chamber to said second chamber;

a second communicating portion configured to permit movement of the developer from said second chamber to said first chamber;

a first feeding screw provided in said first chamber and configured to feed the developer in a first direction from said second communicating portion toward said first communicating portion;

a second feeding screw provided in said second chamber and including a first screw portion configured to feed the developer in a second direction from said first communicating portion toward said second communicating portion, and a second screw portion configured to feed the developer in the first direction; and a developer discharge portion configured to discharge a part of the developer from said developing device, wherein with respect to the second direction, said second screw portion is disposed downstream of said first screw portion and upstream of said developer discharge portion, wherein a downstream edge of said first screw portion with respect to the second direction opposes said second communicating portion, wherein a downstream edge of said second screw portion with respect to the first direction opposes said second communicating portion, wherein said second screw portion is formed in the form of a plurality of threads, wherein the number of threads of said second screw portion is larger than the number of threads of said first screw portion, and wherein said first screw portion and said second screw portion satisfy the following relationships:

$$n \times L \geq P2,\ L \leq P2 \text{ and } P2 \geq P1,$$

where n is the number of threads of said second screw portion, L is a length of said second screw portion in the first direction, P1 is a lead of said first screw portion, and P2 is a lead of said second screw portion.

2. A developing device according to claim 1, wherein L satisfies the following relationship:

$$10\ (\text{mm}) \leq L \leq 40\ (\text{mm}).$$

3. A developing device according to claim 1, wherein L satisfies the following relationship:

$$20\ (\text{mm}) \leq L \leq 30\ (\text{mm}).$$

4. A developing device according to claim 1, wherein said first feeding screw feeds the developer from said first chamber to said developer carrying member.

5. A developing device according to claim 1, wherein said first screw portion is formed in a single thread.

6. A developing device, comprising:

a developer carrying member configured to carry a developer containing toner and a carrier for developing an electrostatic latent image formed on an image bearing member;

a developing container including a first chamber and a second chamber partitioned from said first chamber by a partition wall and configured to accommodate the developer;

a first communicating portion configured to permit movement of the developer from said first chamber to said second chamber;

a second communicating portion configured to permit movement of the developer from said second chamber to said first chamber;

a first feeding screw provided in said first chamber and configured to feed the developer in a first direction from said second communicating portion toward said first communicating portion;

a second feeding screw provided in said second chamber and including a first screw portion configured to feed the developer in a second direction from said first communicating portion toward said second communicating portion, and a second screw portion configured to feed the developer in the first direction; and a developer discharge portion configured to discharge a part of the developer from said developing device, wherein with respect to the second direction, said second screw portion is disposed downstream of said first screw portion and upstream of said developer discharge portion, wherein the number of threads of said second screw portion is larger than [[a]] the number of threads of said first screw portion, and wherein said first screw portion and said second screw portion satisfy the following relationships:

$$n \times L > P2, \text{ and } P2 \geq P1,$$

where n is the number of threads of said second screw portion, L is a length of said second screw portion in the first direction, P1 is a lead of said first screw portion, and P2 is a lead of said second screw portion.

7. A developing device according to claim 6, wherein said first screw portion is formed in a single thread.

8. A developing device according to claim 6, wherein said first feeding screw feeds the developer from said first chamber to said developer carrying member.

9. A developing device according to claim 6, wherein L satisfies the following relationship:

$$10\ (\text{mm}) < L < 40\ (\text{mm}).$$

10. A developing device according to claim 6, wherein L satisfies the following relationship:

$$20\ (\text{mm}) < L < 30\ (\text{mm}).$$

11. A developing device, comprising:

a developer carrying member configured to carry a developer containing toner and a carrier for developing an electrostatic latent image formed on an image bearing member;

a developing container including a first chamber and a second chamber partitioned from said first chamber by a partition wall and configured to accommodate the developer;

a first communicating portion configured to permit movement of the developer from said first chamber to said second chamber;

a second communicating portion configured to permit movement of the developer from said second chamber to said first chamber;

a first feeding screw provided in said first chamber and configured to feed the developer in a first direction from said second communicating portion toward said first communicating portion;

a second feeding screw provided in said second chamber and including a first screw portion configured to feed the developer in a second direction from said first communicating portion toward said second communicating portion, and a second screw portion configured to feed the developer in the first direction; and a developer discharge portion configured to discharge a part of the developer from said developing device, wherein with respect to the second direction, said second screw portion is disposed downstream of said first screw portion and upstream of said developer discharge portion, wherein a downstream edge of said first screw portion with respect to the second direction opposes said second communicating portion, wherein a downstream edge of said second screw portion with respect to the first direction opposes said second communicating portion, wherein said second screw portion is formed in the form of a plurality of threads, wherein said first screw portion is formed in a single thread, and wherein said first screw portion and said second screw portion satisfy the following relationships:

$$n \times L > P2 \text{ and } P2 > P1,$$

where n is the number of threads of said second screw portion, L is a length of said second screw portion in the first direction, P1 is a lead of said first screw portion, and P2 is a lead of said second screw portion.

12. A developing device according to claim 11, wherein L satisfies the following relationship:

$$10\ (\text{mm}) < L < 40\ (\text{mm}).$$

13. A developing device according to claim 11, wherein L satisfies the following relationship:

$$20\ (\text{mm}) < L < 30\ (\text{mm}).$$

14. A developing device according to claim 11, wherein said first feeding screw feeds the developer from said first chamber to said developer carrying member.

* * * * *